United States Patent [19]

Urrestarazu Borda

[11] Patent Number: 5,014,989

[45] Date of Patent: May 14, 1991

[54] MECHANICAL LOTTERY

[76] Inventor: Rafael Urrestarazu Borda, Po Oriamendi, Bo Ayete, San Sebastián, Spain, 28009

[21] Appl. No.: 378,639

[22] Filed: Jul. 12, 1989

[30] Foreign Application Priority Data

Feb. 23, 1989 [ES] Spain ..... 8900664

[51] Int. Cl.[5] ..... A63F 9/04

[52] U.S. Cl. ..... 273/145 C; 273/145 R

[58] Field of Search ..... 273/145 R, 145 A, 145 C, 273/145 CA

[56] References Cited

U.S. PATENT DOCUMENTS

| | | | |
|---|---|---|---|
| 502,876 | 8/1893 | Cahoon | 273/145 CU X |
| 2,639,153 | 5/1953 | Murray | 273/145 C |
| 3,508,755 | 4/1970 | Johnson | 273/145 C |

FOREIGN PATENT DOCUMENTS

| | | | |
|---|---|---|---|
| 3302179 | 8/1984 | Fed. Rep. of Germany | 273/145 C |
| 461493 | 10/1913 | France | 273/145 C |

*Primary Examiner*—Edward M. Coven
*Assistant Examiner*—Raleigh W. Chiu
*Attorney, Agent, or Firm*—Toren, McGeady & Associates

[57] ABSTRACT

It consists of a hollow, transparent prismatic-rectangular body open at one of its bases at which a cover is positioned, having a plurality of internal partitions forming compartments in which respective dice are housed, which cover can in no way be uncoupled from the mouth of the body without destroying the game, so that the dice cannot be manipulated directly by hand, but only by shaking the cover-body assembly. Nevertheless, the cover is displaceable towards the bottom of the body to a full locking position for the dice, in order to maintain a determined combination thereof, subject to a prize, stable, this locking position being secured with the help of means which locks the cover in opposition to springs which tend to house it in the body mouth.

6 Claims, 3 Drawing Sheets

MECHANICAL LOTTERY

OBJECT OF THE INVENTION

The present invention refers to a game of chance, specifically to a game in which a series of dice is used, by means of which a determined combination which, in turn, is subject to a prize, may be obtained.

BACKGROUND OF THE INVENTION

There are in existence various types of games which are played with a set of dice. However, all of them include, as the common denominator, the fact that the said dice are directly and independently accessible, which means that any specific combination can be established by tampering with the dice.

This means that when an attempt is made to establish any kind of prize in any one of these games of chance based on dice, the presence of one or more persons acting as "judges", along with that of the player, is absolutely necessary to verify and testify that a determined alphanumeric combination has been reached without having unduly tampered with the dice.

Consequently, this restricts the possibilities of practical use of this type of games of chance to a rather considerable degree.

DESCRIPTION OF THE INVENTION

None the less, it would be desirable to offer the market with a game of chance based on dice which, for example, were distributed by a determined commercial firm to its real or potential clients, along with the parallel offer of a larger or smaller prize, which can be obtained by reaching a determined alphanumeric combination in any one of the dice games, but with the special feature that these dice may be handled by each consumer or user independently without the need of personal control or supervision, and parallelly without the possibility of fraudulency in the results, an objective which cannot obviously be accomplished with the games of chance existing in the market.

Thus, for accomplishing this objective, the game of chance of the invention is comprised of a hollow, preferably prismatic-rectangular body, open at one of its bases and provided interiorly with a plurality of partitioned compartments forming as many receptacles as dice used in the game. However, the said partitions are physically independent from one another, all of them protruding from the closed base of the said body. The body is completed with a cover which, in principle, closes its open base and consequently the multiple compartments formed therein. However, the said cover is capable of penetrating into the body, for which purpose it is provided with slots along which the said partitioned compartments slide to a full position at which the dice are locked at any position reached, establishing between the body and the cover fixing means, such as for example retractable bolts which lock the cover in the said position.

Additionally to the described structure, flat lugs protrude from the cover. To the said lugs are securely joined stems which are positioned sideways with respect to the body and which, in turn, pass through other lugs emerging from the closed base of this latter. The free ends of the said stems are riveted, or any other means is established therefor for insuring that the body and the cover are in no way uncoupled, to manually and directly handle the dice, without the said fraudulent tampering being detected.

Obviously, and so that the lugs emerging from the cover do not present a drawback during the displacement thereof within the body, this incorporates at its smaller side walls and in correspondence with the said lugs, slotted windows permitting the said displacement, which displacement takes place in opposition to the tension of springs coaxially coupled to the guide stems, and which cause the cover to occupy the end position at which the receptacles for the respective dice have a maximum volumetry.

Thus, in accordance with the described structure, the game may be shaked as many times as desired, obtaining at the end of each shaking a determined combination in the group of dice used, the player only having the possibility of locking the said dice at a determined moment and once a determined combination has been reached.

DESCRIPTION OF THE DRAWINGS

To complete the aforegoing description and for a better understanding of the characteristics of the invention, a set of drawings is accompanied, forming an integral part thereof, in which merely by way of illustration and not limiting, the following is represented.

FIF. 2 illustrates a sectional, side elevational view of the unit of the preceding figure, duly assembled, in a dice-freeing position.

Figure 2:
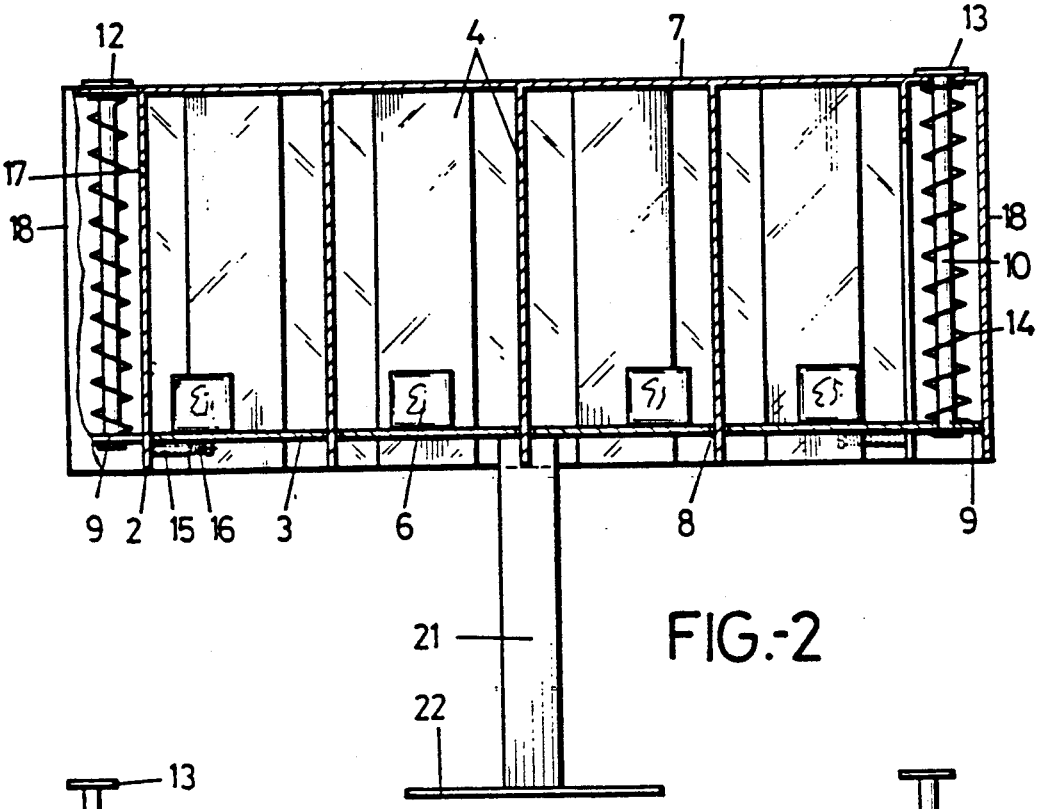
Figure 3:
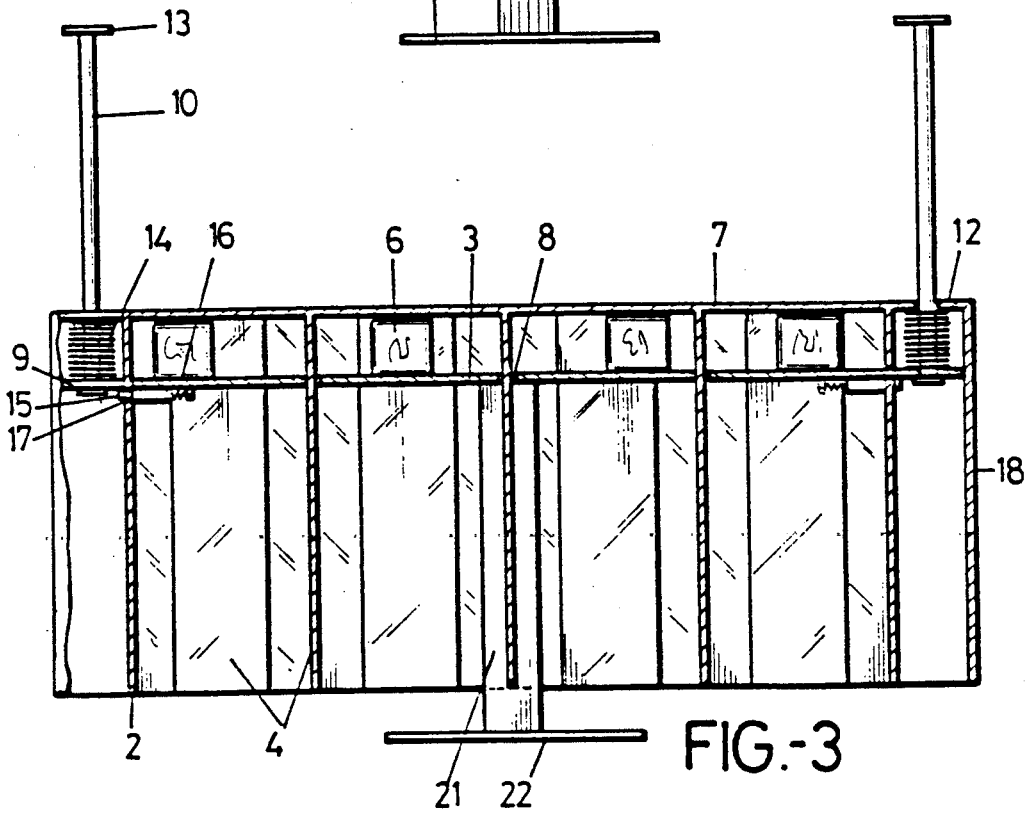

FIG. 3 illustrates a view similar to that of FIG. 2, but corresponding to a position of the game at which the dice are blocked and locked.

Figure 4:
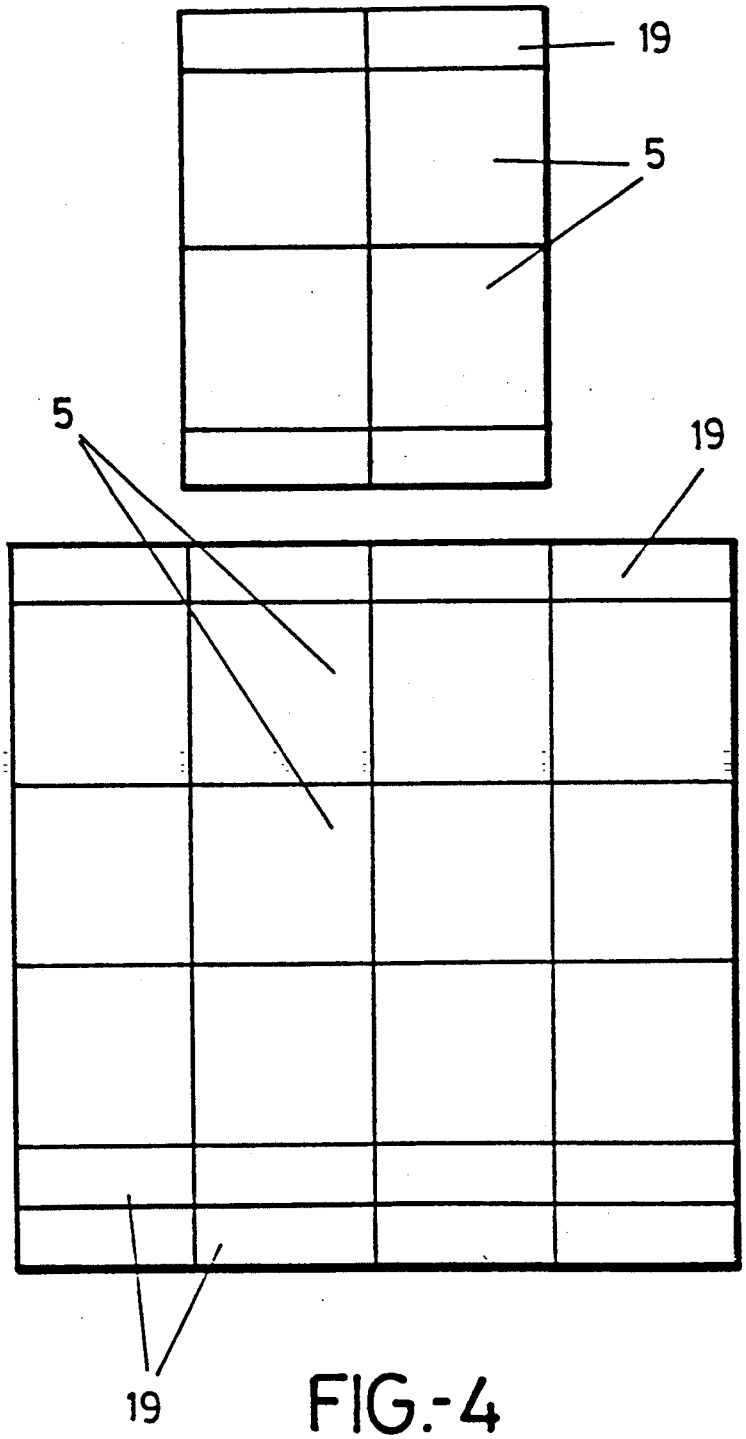

FIG. 4, finally, illustrates two plan schematic representations of the same game, corresponding to embodiments in which four and twelve dice, respectively, are used, wherefore obviously the number of dice could vary without practically any limitation whatsoever.

PREFERRED EMBODIMENT OF THE INVENTION

Referring to these figures, it can be seen that the game of chance of the invention is comprised of a hollow body 1, having a prismatic-rectangular configuration, open at its lower base 2 and made from a transparent material, such as for example methacrylate or any other suitable plastic material, the body 1 being completed with a cover 3 adaptable to its mouth or open base 2 and capable of penetrating therein.

Inside the body 1 there is established a plurality of partitioned compartments 4 designed for constituting receptacles 5, as those schematically represented in FIG. 4, in which the respective dice 6 are housed.

Figure 1:
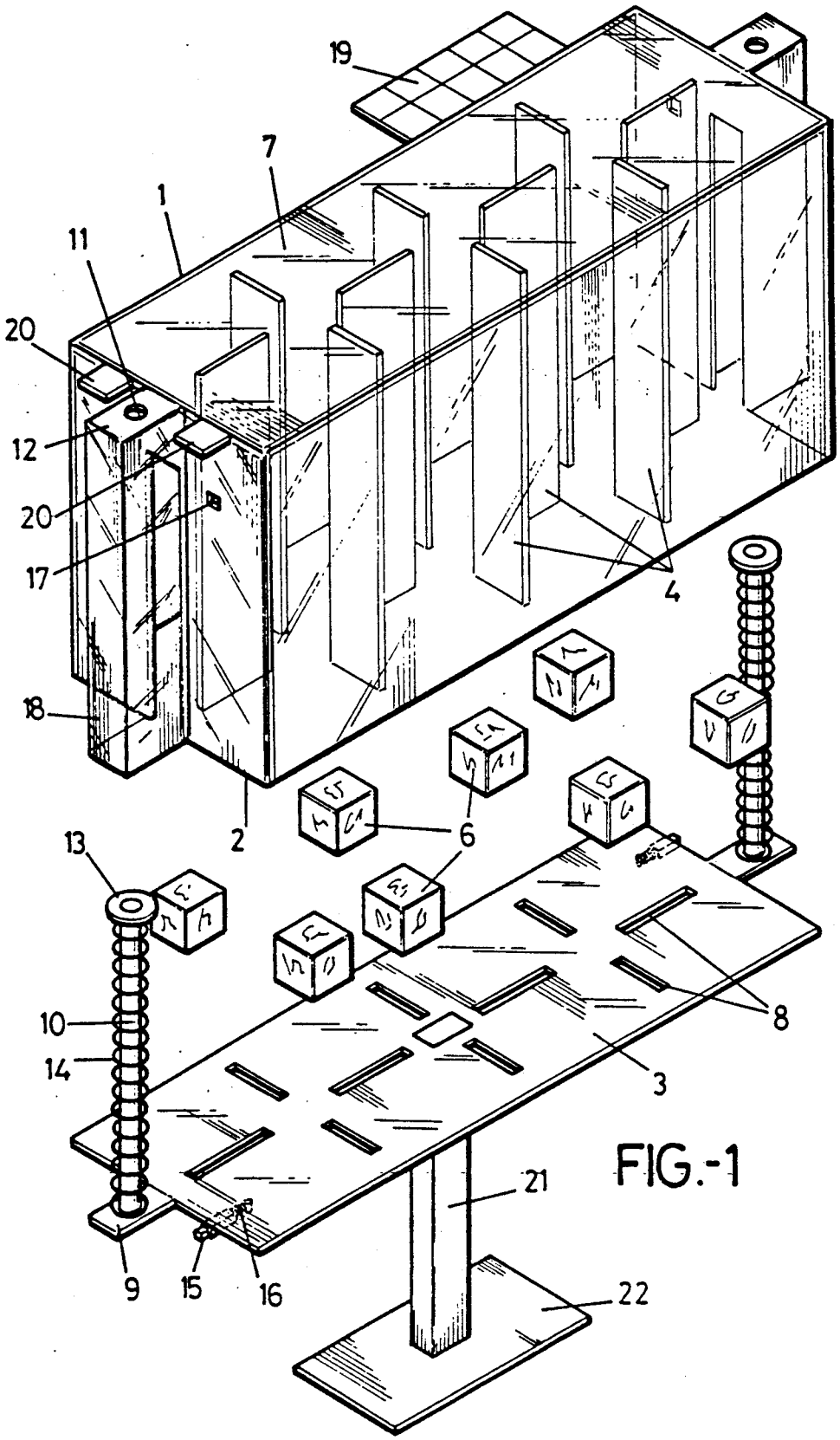
FIG. 1 illustrates an exploded perspective view of the game of chance made in accordance with the present invention and in accordance with a practical mode of embodiment thereof in which eight dice are used.

Since all these partitioned compartments 4 emerge jointly from the closed base 7 of the upper base of the body 1, they present the characteristic, as specially seen in FIG. 1, that they are physically independent from one another, being spaced in a wide but insufficient magnitude for the dice to pass from one housing to another. The obvious purpose of this independent character of the partitions 4 is that although it permits the cover 3 to be made in one piece, such cover can none the less be displaceable inside the body 1, specifically by providing the said cover with a plurality of slots 8, numerically and positionally coincident with the partitions 4 and dimensionally coincident in turn with the section of these latter.

To maintain the cover 3 permanently joined to the body 1 and the compartments 5 inaccessible from the outside, so that the dice 6 cannot be tampered with, the said cover incorporates at its end zones prolongations determining lugs 9 from which there emerge vertically and jointly respective stems 10 which, once they have passed through the holes 11 of the lugs 12 in which, in turn, are a prolongation of the closed base 7 of the body 1, terminate in an expansion 13 acting as the retention means and obtained by any inviolable means, such as for example by riveting, the arrangement of a welded head, etc., or in general any kind of retention means which, if manipulated, enables such manipulation to be immediately detected.

Additionally, and in order to maintain the game in the operative position shown in FIG. 2, on the stems 10 are mounted respective springs 14 which tend to maintain the cover 3 in the proximities of the mouth 2 of the body, and in opposition to which springs the said cover is displaceable inwards of the body towards the full position shown in FIG. 3, at which the dice 6 are blocked and consequently locked, showing a determined combination.

To make this position of the cover stable, the cover incorporates locking means, such as for example the retractable bolts 15 shown in the drawings which are capable of being automatically locked, due to the effect of the springs 16 which assist them, in holes or windows 17 operatively made in the body 1.

The stems 10 and specially the springs 14, in turn, could be suitably protected by tubular, lateral expansions 18 of the body 1, open at thier ends, on which ends the lugs 9 and 12 are repectively positioned.

Nevertheless and as it is obvious, there is no need for these lugs 9 and 12 as well as the tubular protecting expansions 18 to exist. The stems 10 along with their corresponding springs 14 will be housed inside the body 1, protruding directly from the cover 3 at end points of its major axis or any other suitable site, and passing through corresponding holes of the closed base 7 of the cover.

As previosly stated, eight dice can be used in the game, in accordance with the practical embodiment of FIGS. 1 to 3, establishing therein eight compartments 5, or this number of compartments could vary without practically any limitation whatsoever in such respect, depending upon the number of dice used in the game and, more specifically, depending on the degree of difficulty contemplated for obtaining the combination subject to a prize.

In any case, the body 1 can be provided with signalling lugs 19 and 20 which aid in identifying the prize-winning combination, and to the cover 3 may be secured, centrally, a small column 21 for supporting the assembly, terminated in the corresponding base 22 without affecting the main characteristics of the invention.

It is not considered necessary to further extend this description so that any person skilled in the art may understand the scope of the invention and the advantages derived therefrom.

The materials, shape, form and arrangement of the elements could be varied, provided that the essential features of the invention are not modified.

The terms in which this specification has been described should be regarded in a broad rather than a restrictive sense.

What is claimed is:

1. A mechanical lottery comprising a hollow, transparent, prismatic-rectangular body, open at one of its bases, in which body there are arranged a plurality of partitioned compartments open towards the same open base of the body, the body being completed with a transparent cover which closes the open base and the compartments, a die being disposed in each of the compartments, the cover being undetachable from the body, so that the compartments are completely inaccessible without breaking the assembled body and cover, so that a prize combination of the alphanumeric top faces of the dice can only be achieved by shaking the body-cover assembly.

2. A mechanical lottery according to claim 1, wherein the cover is displaceable towards the closed base of the body, to block the dice when the prized combination is achieved, for which purpose the partitions of the compartments are independent and spaced from one another, while the cover incorporates a plurality of slots corresponding with the partitions along which the cover is displaceable.

3. A mechanical lottery according to claim 1, and further comprising at least one pair of stems secured to the cover so as to emerge perpendicularly therefrom, and pass through the body by means of corresponding holes, the stems having on the outside of the holes expansions acting as retention butts, respective springs being mounted on the stems so as to tend to direct the cover towards a full maximum spacing position with respect to the bottom of the body, a full position being defined by incidence of the end expansions of the stems on the body base.

4. A mechanical lottery according to claim 3, wherein the stems are formed in flat lugs which are a prolongation of the cover in correspondence with the ends of its major axis, the holes of the body are, in turn, established in flat lugs which are a prolongation of its closed base also in correspondence with its major axis, the body incorporating at its smaller side walls centered slots for sliding of the lugs of the cover, the body further incorporates at these zones tubular expansions, the section of which is coincident with the configuration of the lugs, which are closed at one of their ends by the corresponding lug of the body and which constitute guides for the lugs of the cover.

5. A mechanical lottery according to claim 1, and further comprising blocking means at a full penetration position of the cover within the body, including small retractable bolts joined to the cover, permanently directed towards the blocking position due to the effect of respective springs, the body having at its smaller side walls tiny holes or windows for receiving the bolts.

6. A mechanical lottery according to claim 1, wherein the body further incorporates laminar prolongations or lugs as a physical support for the information corresponding to the prize combination.

* * * * *